US006948983B1

(12) United States Patent
Peng

(10) Patent No.: US 6,948,983 B1
(45) Date of Patent: Sep. 27, 2005

(54) SLIM USB MALE CONNECTOR WITH ANTI-DISORIENTATION DESIGN

(75) Inventor: Morris Peng, Tu Cheng (TW)

(73) Assignee: Megaforce Company Limited, Taipei Hsien (TW)

( * ) Notice: Subject to any disclaimer, the term of this patent is extended or adjusted under 35 U.S.C. 154(b) by 0 days.

(21) Appl. No.: 10/914,180

(22) Filed: Aug. 10, 2004

(51) Int. Cl.[7] ..... H01R 9/09
(52) U.S. Cl. ..... 439/660; 439/108
(58) Field of Search ..... 439/108, 660, 439/620, 541.5, 567, 176, 607, 160, 76.1, 439/101

(56) References Cited

U.S. PATENT DOCUMENTS

| | | | | |
|---|---|---|---|---|
| 6,827,605 | B2 * | 12/2004 | Wu | 439/567 |
| 6,835,091 | B2 * | 12/2004 | Oleynick et al. | 439/541.5 |
| 6,854,984 | B1 * | 2/2005 | Lee et al. | 439/79 |
| 6,860,762 | B2 * | 3/2005 | Spykerman et al. | 439/620 |
| 2002/0013074 | A1 * | 1/2002 | Dong | 439/79 |
| 2003/0100203 | A1 * | 5/2003 | Yen | 439/79 |
| 2003/0134529 | A1 * | 7/2003 | Murr et al. | 439/79 |
| 2004/0029421 | A1 * | 2/2004 | Yen | 439/79 |
| 2004/0029422 | A1 * | 2/2004 | Yen | 439/79 |
| 2004/0038565 | A1 * | 2/2004 | Yen | 439/79 |
| 2004/0175976 | A1 * | 9/2004 | Park | 439/176 |
| 2005/0085133 | A1 * | 4/2005 | Wang et al. | 439/660 |

* cited by examiner

*Primary Examiner*—P. Austin Bradley
*Assistant Examiner*—Phuongchi Nguyen
(74) *Attorney, Agent, or Firm*—Rosenberg, Klein & Lee

(57) ABSTRACT

A slim USB male connector with anti-disorientation design is mated with a USB socket. The USB male connector is received in a space between a mating board and a bottom wall of the USB socket. The USB male connector comprises a circuit board and an insulative housing. A top surface of USB male connector is mounted with four contacts. A bottom surface of the USB male connector is mounted with a grounding plate. The insulative housing covers the circuit board and has a plurality of grooves therein, and a pair of guiding boards respectively protruding from two sides thereof. The pair of guiding boards are respectively inserted into side gaps between the mating board and two sides of the frame of the USB socket.

9 Claims, 9 Drawing Sheets

SLIM USB MALE CONNECTOR WITH ANTI-DISORIENTATION DESIGN

BACKGROUND OF THE INVENTION

1. Field of the Invention

The present invention relates to a slim USB male connector with anti-disorientation design, and particularly to a slim USB male connector complying with A-type USB specifications with an anti-disorientation device.

2. Description of the Prior Art

The Universal Serial Bus (USB) is an astonishingly useful way to connect large numbers of peripherals together. It is becoming increasingly important in today's electronics world. One of the reasons that USB was implemented was to replace existing serial and parallel ports on computers. USB has several advantages for this application.

First, it uses a much higher data transfer rate than many common serial data formats. Second, it allows a large number of devices to be attached to a single host USB connector. Up to 127 devices can theoretically be used on a single USB port. Third, it simplifies the connection to external devices. USB supports "plug and play"—the operator does not need to be heavily involved in the set-up process. When a device is connected to a host's USB bus, it is immediately recognized by the host, dynamically enumerated, and assigned an address by the host.

Reference is made to FIG. 1, which is a perspective view of an A-type USB socket (a female connector) and a USB connector (a male connector). The A-type USB socket 70 and USB connector 90 follow with A-type physical specifications for achieving electrical connection. The USB socket 70 is usually mounted on a PCB 80 of the host (not shown) grounded to the computer system. The USB socket 70 has a frame 72 and a mating board 76 mounted in the frame 72. The frame 72 is formed by stamping a metal board and formed with a plurality of elastic tongues 74 on a periphery of the frame 72. The mating board 76 is formed with an insulative material and mounted with four contacts 78. A receiving space 79 is formed between the mating board 76 and the frame 72. The USB connector 90 uses a four-wire cable interface 91. Two of the wires are used in a differential mode for both transmitting and receiving data, and the remaining two wires are power and ground. The power source for a USB device can come from the host, or a hub. The USB connector 90 has a housing 92 made by stamping and formed with four cutouts 94 thereon, and a mating board 96 that is mounted in the housing 92 and disposed with four terminals 98 on an upper surface thereof. The housing 92 complies with USB-IF grounding requirements by grounding with a computer via the USB socket 70. When the USB connector 90 is inserted into the USB socket 70, the tongues 74 of the frame 72 of the USB socket 70 are clipped and wedged in the cutouts 94 of the housing 92. The four terminals 98 of the mating board 96 are respectively electrically connected with the contacts 78 of the mating board 76.

However, the metal housing 92 limits the size of the USB connector 90. When the USB connector 90 is inserted into a stacked USB socket, it is crowded with the neighbor USB connector and thus inconvenient. The slim design of the USB connector 90 is thus restricted by the housing 92 and the housing 92 becomes an obstacle to slim design.

Hence, an improved slim USB male connector is required to overcome the disadvantages of the prior art.

SUMMARY OF THE INVENTION

The main object of the present invention is to provide a slim USB male connector with anti-disorientation design, and in particular to a USB male connector that has a compact contour without the metal housing and complies with A-type USB specifications with an anti-disorientation design for avoiding disorientation of the USB male connector in the USB socket.

In order to achieve the above object, the present invention provides a slim USB male connector with anti-disorientation design mated with a USB socket. The USB socket has a frame stamped with a plurality of tongues, a mating board mounted in the frame, and four terminals mounted on a bottom of the mating board. The USB male connector is received in a space between the mating board and a bottom wall of the frame. The USB male connector comprises a circuit board and an insulative housing. The circuit board has a top surface and a bottom surface. The top surface is mounted with four contacts thereon for respectively contacting with the four terminals. The bottom surface is mounted with a grounding plate for contacting with the tongues of the USB socket. The insulative housing covers a periphery of the circuit board and has a plurality of grooves formed therein exposing the contacts and the grounding plate outside, and a pair of guiding boards respectively protruding from two sides thereof. The pair of guiding boards are respectively inserted into side gaps between the mating board and two sides of the frame of the USB socket. Other objects, advantages and novel features of the present invention will become more apparent from the following detailed description of the present embodiment when taken in conjunction with the accompanying drawings.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENTS

Figure 1:
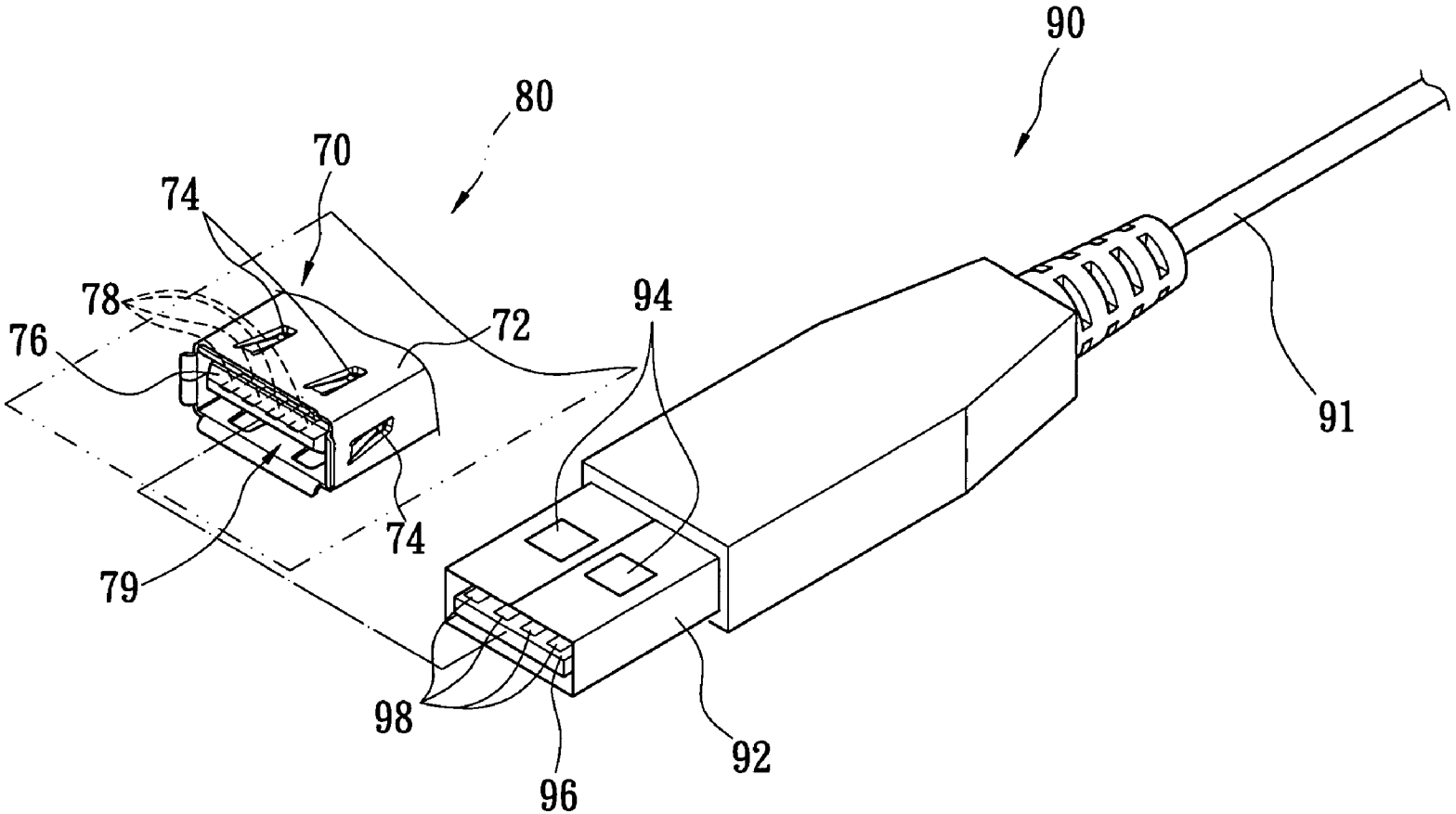
FIG. 1 PRIOR ART
FIG. 1 is a perspective view of a conventional A-type USB socket and a USB connector.
Figure 2:
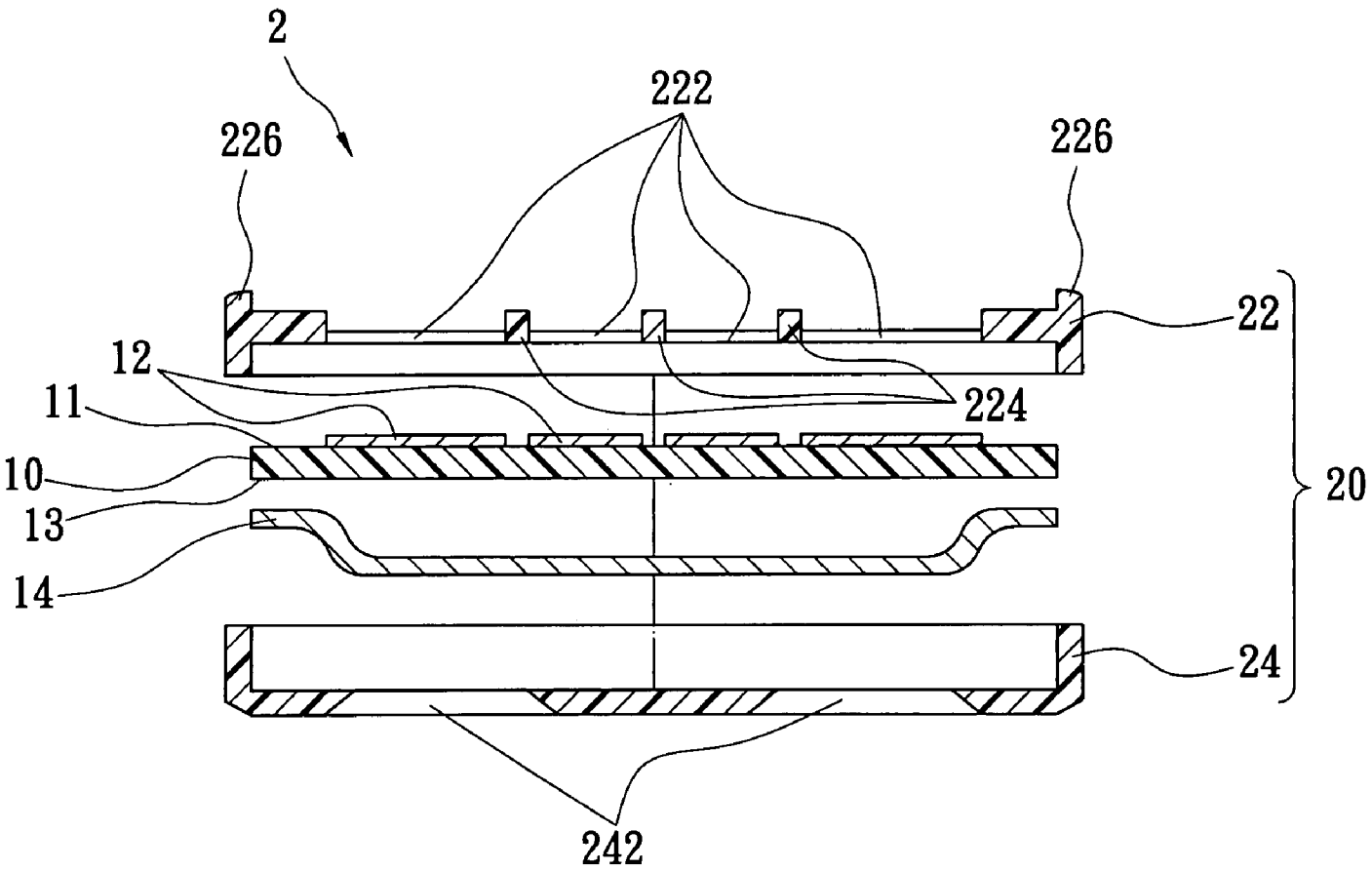
FIG. 2 is an exploded cross-section view of a slim USB male connector with anti-disorientation design according to the present invention.

Referring to FIG. 2, which is an exploded cross-section view of a slim USB male connector with anti-disorientation design according to the present invention, the slim USB male connector 2 is mated with the USB socket 70 of the prior art. The USB socket 70, as mentioned above, has a frame 72 stamped with a plurality of elastic tongues 74, a mating board 76 mounted in the frame 72, and four terminals mounted on a bottom of the mating board 76. A space 79 is formed between the mating board 76 and a bottom wall of the frame 72.

The USB male connector 2 is received in the space 79 of the USB socket 70. The USB male connector 2 comprises a circuit board 10, and an insulative housing 20 covering the circuit board 10.

The circuit board 10 is formed with a plurality of circuits (not shown) on a top surface 11 and a bottom surface 13 thereof. The circuit board 10 comprises four contacts 12, and a grounding board 14.

The four contacts 12 are made of conductive metal, and mounted on the top surface 11 of the circuit board 10 and connected with the corresponding circuits thereon. The size of the four contacts 12 complies with the four contacts 78 of the USB socket 70 physically and electrically. The four contacts 12 are contiguously in contact with the contacts 78 of the USB socket 70.

The grounding plate 14 is formed by stamping a metal board. The grounding plate 14 has two ends respectively soldered on the bottom 13 of the circuit board 10 and connected with a grounding circuit thereon. The grounding plate 14 is connected with the tongues 74 of the USB socket 70 for achieving system grounding.

The insulative housing 20 covers a periphery of the circuit board 10. The insulative housing 20 has an upper housing 22 and a lower housing 24 respectively having grooves 222, 242 formed therein to expose the contacts 12 and the grounding plate 14 outside. The upper housing 22 has four upper grooves 222, partitions 224 formed between each two of the upper grooves 22, and a pair of guiding boards 226 respectively protruding from two side edges thereof. The pair of guiding boards 226 are respectively inserted into side gaps between the mating board 76 and two sides of the frame 72 of the USB socket 70. Therefore, the guiding boards 226 can enhance the stability of embedding. If the USB male connector 2 is inserted incorrectly, the guiding boards 226 prevent the insertion and as an anti-disorientation design.

The lower housing 24 of the insulative housing 20 has a pair of grounding grooves 242 for exposing the grounding plate 14 and receiving the tongues 74 of the frame 72 of the USB socket 70 therein. The grounding plate 14 is electrically connecting with the tongues 74 with a fixing function.

Figure 3:
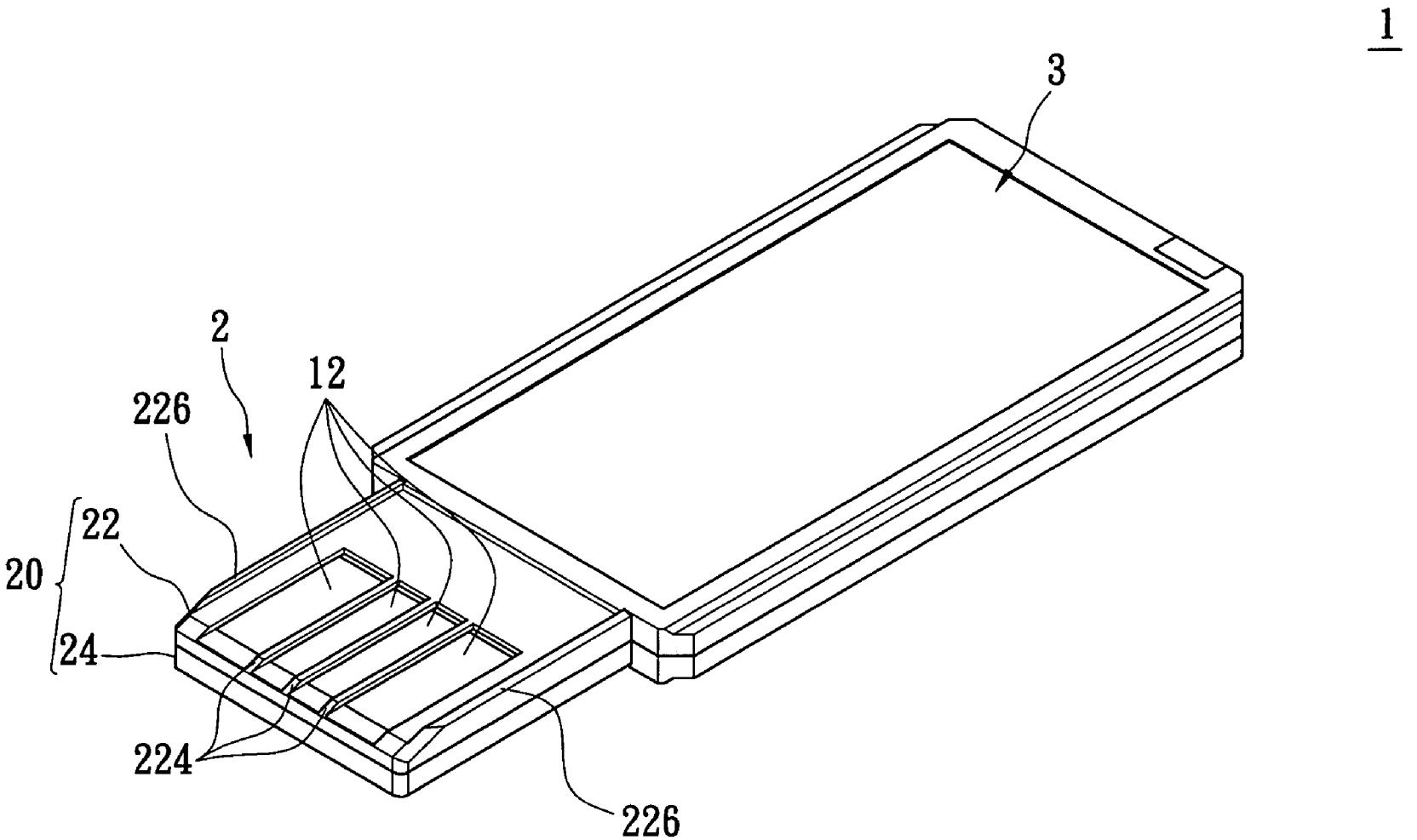
FIG. 3 is a perspective view of the slim USB male connector according to the present invention applied in a storage device.
Figure 4:
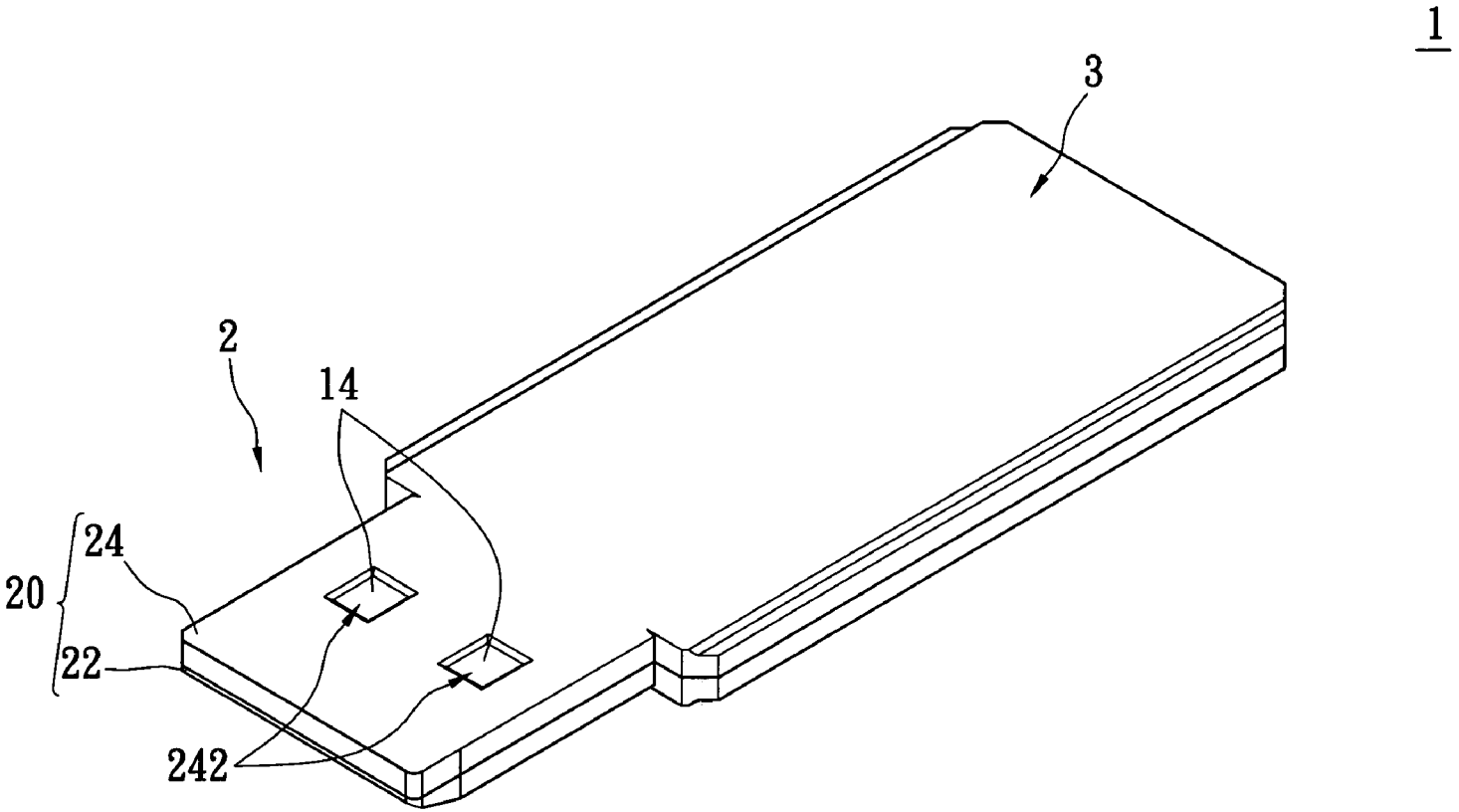
FIG. 4 is a perspective view of the slim USB male connector according to the present invention applied in a storage device from a different viewpoint.
Figure 5:
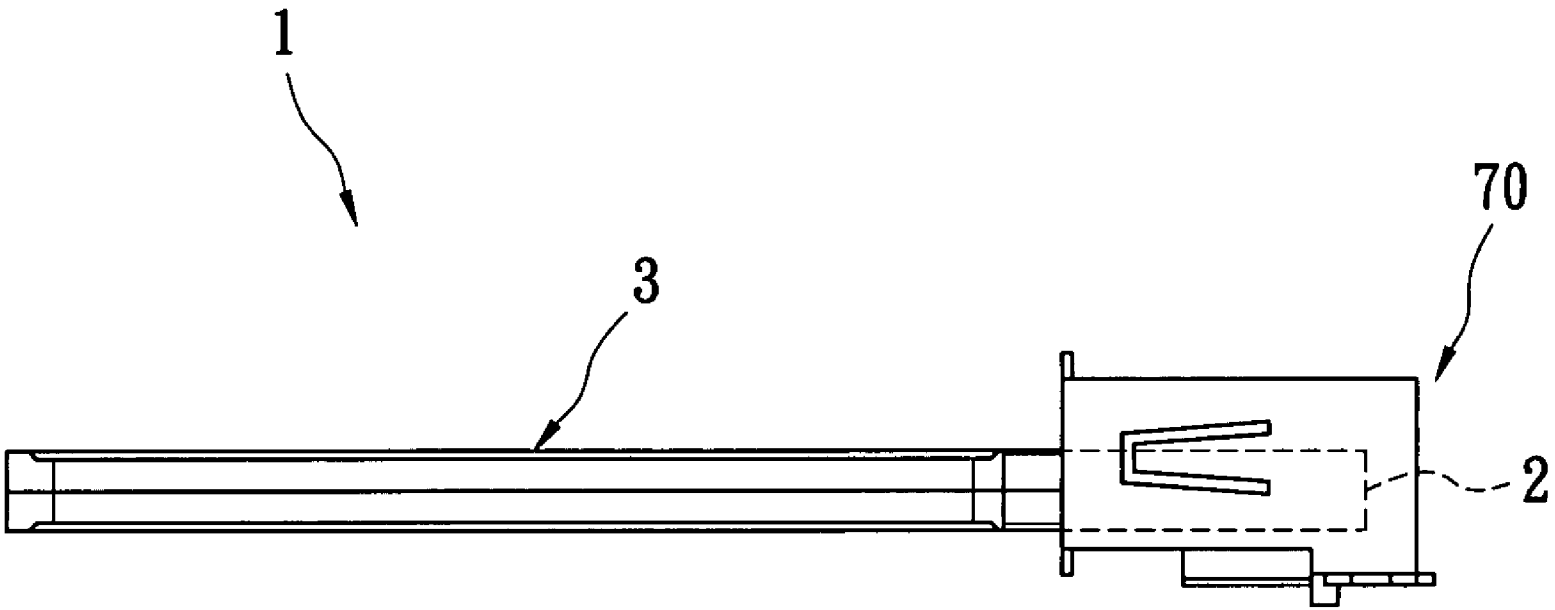
FIG. 5 is a side view of a flash memory card with the present invention plugged in a USB socket.

Reference is made to FIG. 3 and FIG. 4, which are perspective view of the slim USB male connector applied in a storage device from different viewpoints. The slim USB male connector 2 can be applied in different electrical devices with advantages of compactness and portability. The slim USB male connector with system grounding 2 further comprises a storage device 3 extending from an end of the circuit board 10 and forming a flash memory card 1. The flash memory card 1 is more compact and slimmer via the slim USB male connector 2. A plugging portion of the flash memory card 1 is as thin as the storage device 3, and is beneficially applied in electrical devices such as, for example, PDAs, digital cameras and notebooks. A circuit layout of the storage device 3 is not the character of the present invention, and so is not mentioned here.

Figure 6:
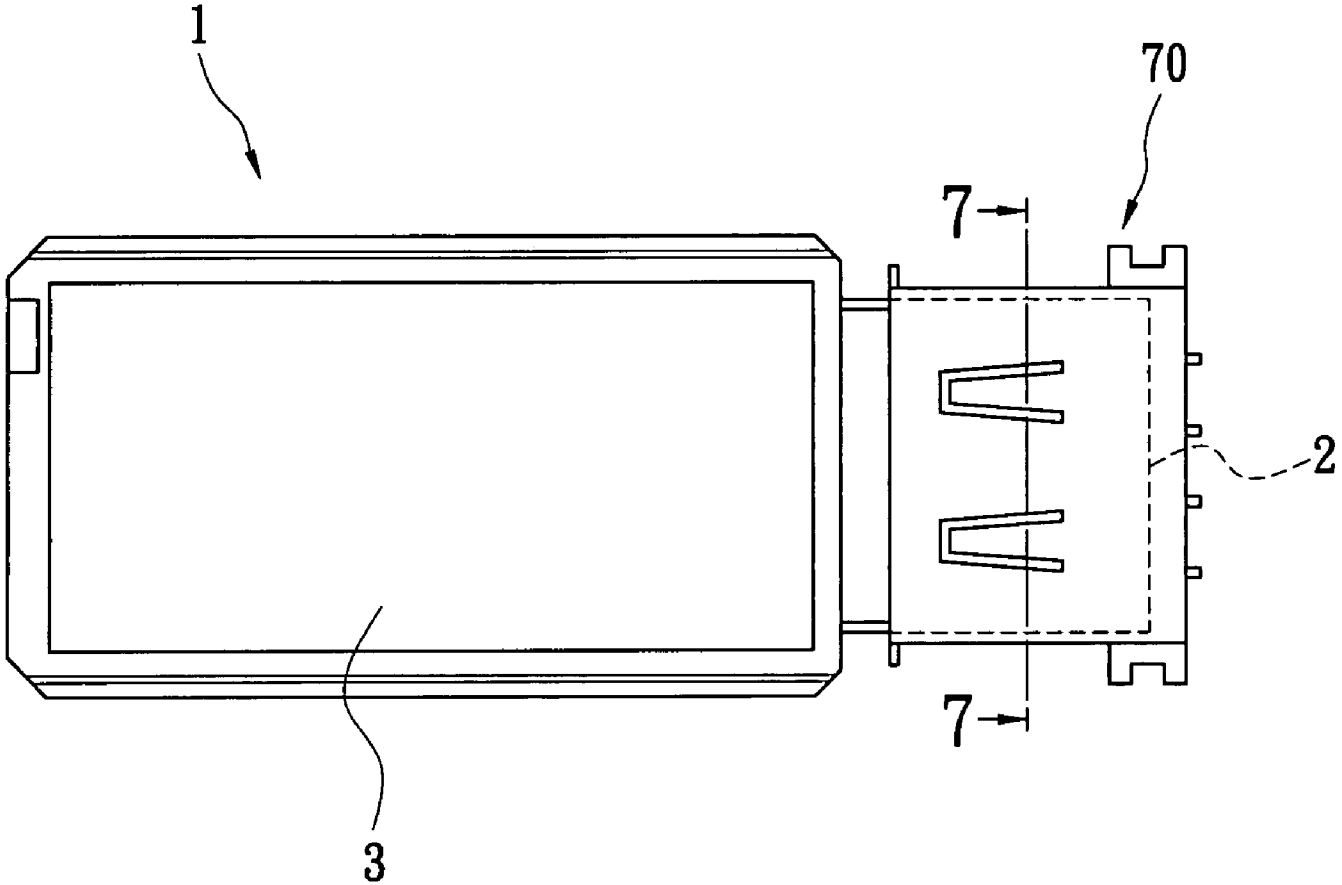
FIG. 6 is a top view of a flash memory card with the present invention plugged in a USB socket.
Figure 7:
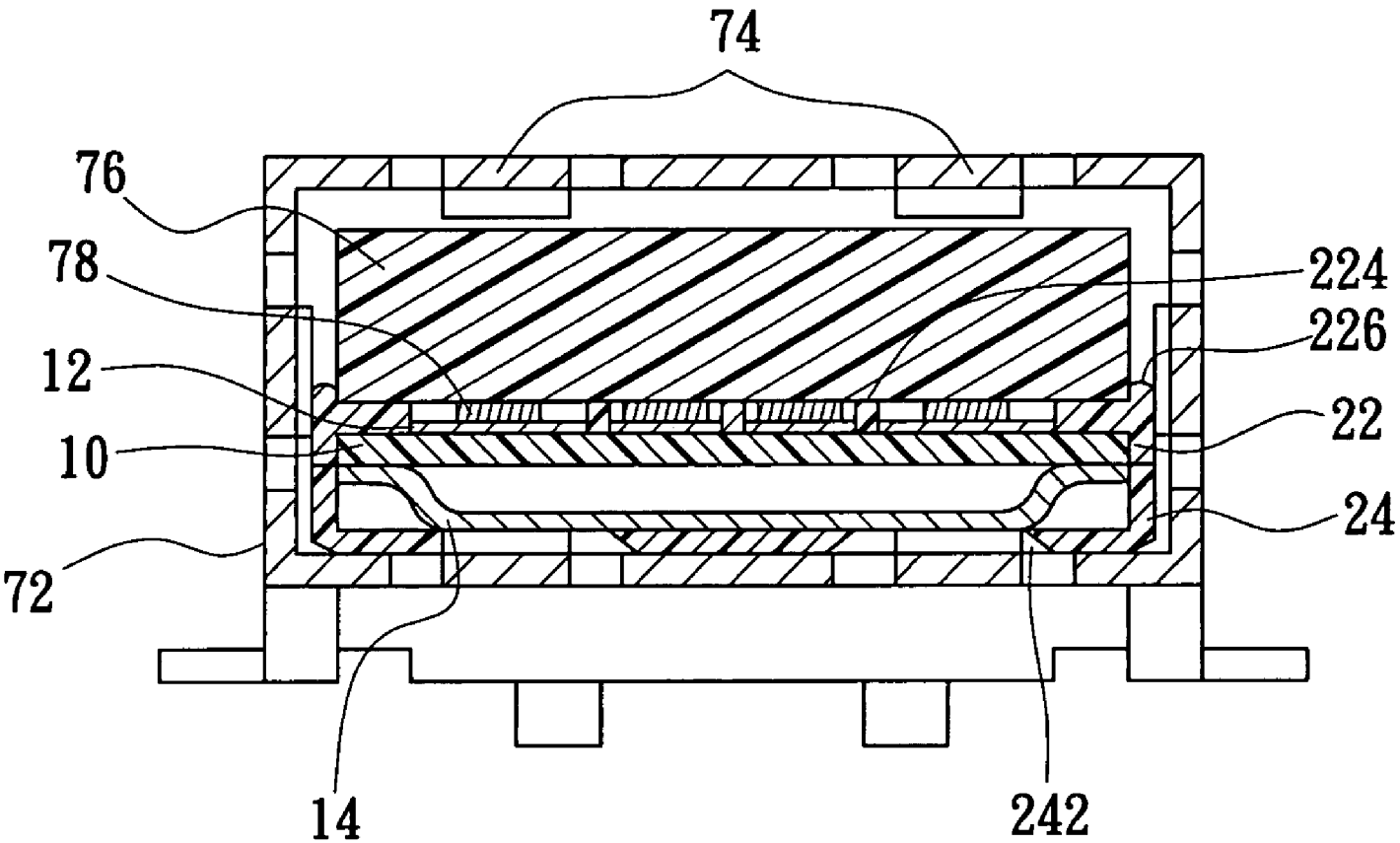
FIG. 7 is a cross-sectional view along line 7—7 in FIG. 6.

Reference is made to FIG. 6 and FIG. 7. FIG. 6 is a side view and top view of a flash memory card with the present invention plugged in a USB socket, and FIG. 7 is a cross-sectional view along line 7—7 in FIG. 6. A special distinguishing feature of the slim male connector 2 of the present invention is that the slim male connector 2 abandons the frame of prior art and replaces the same with an insulative housing 20 of non-metal material. The contacts 12 and the grounding plate 14 are hidden in the insulative housing 20. The slim male connector 2 is only inserted in the lower space 79 of the USB socket 70. The slim male connector 2 complies with the specifications and functions for a USB and also has a hidden grounding design for an anti-disorientation design. The total height of the slim male connector 2 of the present invention is about half that of the USB connector of the prior art, and the width thereof is also reduces. The advantages of the compactness of the present invention are manifested especially in applications involving flash memory.

Figure 8:
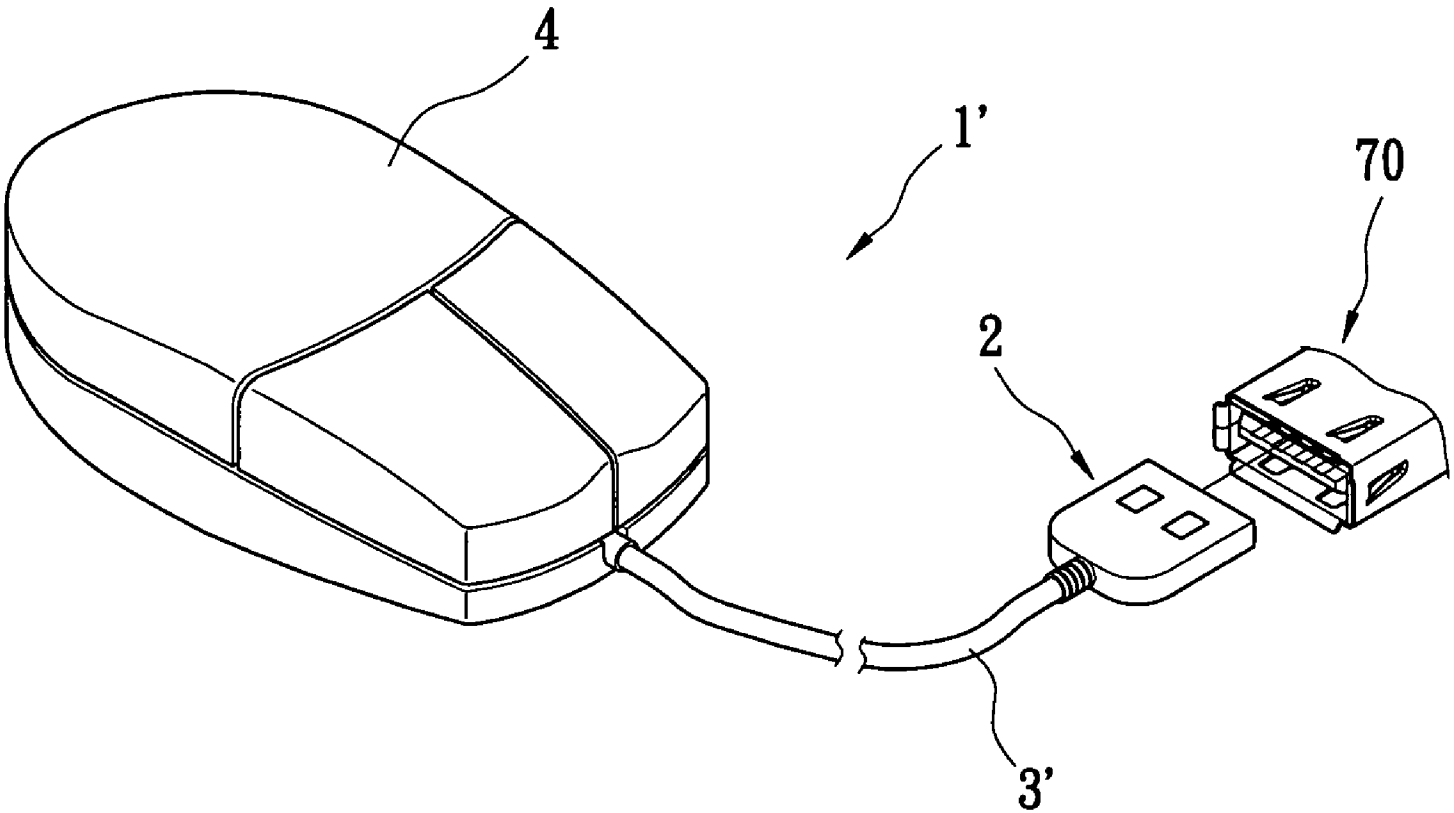
FIG. 8 is a side view of the slim USB male connector according to the present invention applied in computer peripheral device.
Figure 9:
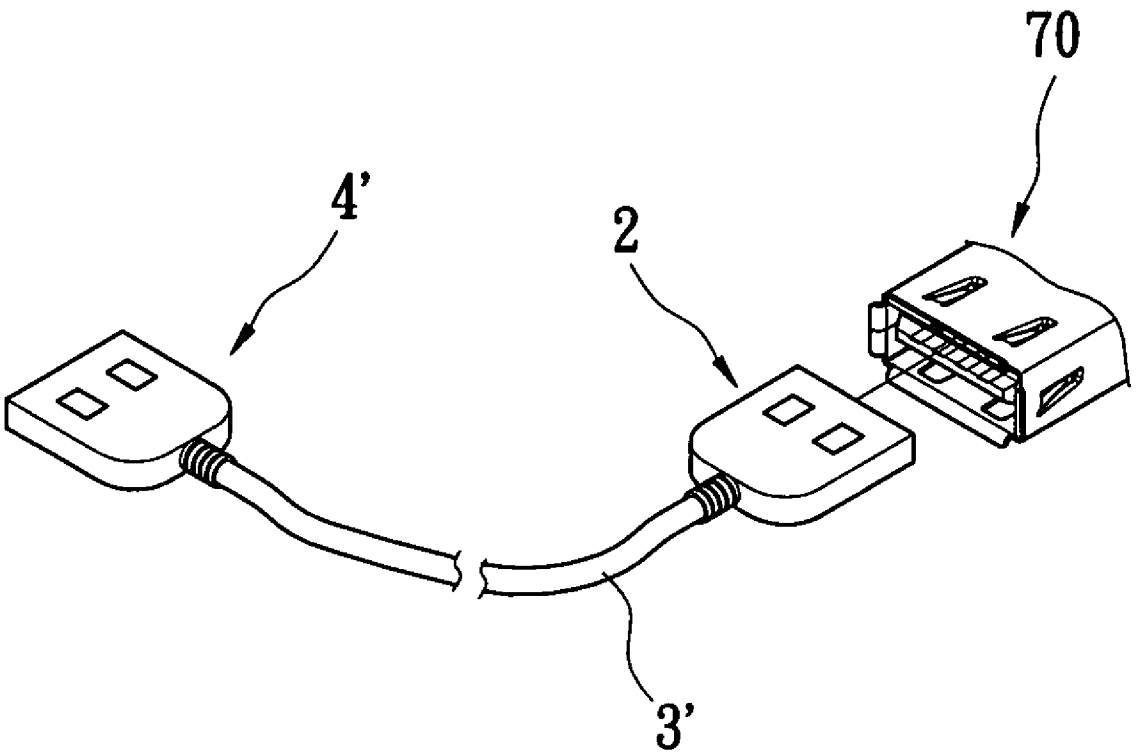
FIG. 9 is a perspective view of a connecting cable combined with the present invention.

Reference is made to FIG. 8, which is a side view of the slim USB male connector applied in a computer peripheral device. The slim male connector 2 of the present invention further comprises a cable 3' connecting with an end of the circuit board 10 and electrically connecting with the circuits of the circuit board 10. The cable 3' can be connected with a computer peripheral 4 such as, for example, a mouse or keyboard. Conversely, the cable 3' can be connected with an electrical connector 4' and form a connecting cable (as shown in FIG. 9) for transferring data between electric devices.

It is to be understood, however, that even though numerous characteristics and advantages of the present invention have been set forth in the foregoing description, together with details of the structure and function of the invention, the disclosure is illustrate only, and changes may be made in detail, especially in matters of shape, size, and arrangement of parts within the principles of the invention to the full extent indicated by the broad general meaning of the terms in which the appended claims are expressed.

What is claimed is:

1. A slim USB male connector with an anti-disorientation design and mating with a USB socket, the USB socket having a frame stamped with a plurality of tongues, a mating board mounted in the frame, and four terminals mounted on a bottom of the mating board, wherein the USB male connector is received in a space between the mating board and a bottom wall of the frame, the slim USB male connector comprising:

a circuit board having a top surface and a bottom surface, the top surface mounted with four contacts thereon for respectively contacting with the four terminals, the bottom surface mounted with a grounding plate for contacting with the tongues of the USB socket; and an insulative housing covering a periphery of the circuit board, the insulative housing having a plurality of grooves formed therein for exposing the contacts and the grounding plate, and a pair of guiding boards respectively protruding from two sides thereof, wherein the pair of guiding boards are respectively inserted into side gaps between the mating board and two sides of the frame of the USB socket.

2. The slim USB male connector with anti-disorientation design as claimed in claim 1, further comprising a storage device extending from an end of the circuit board and forming a flash memory card.

3. The slim USB male connector with system grounding as claimed in claim 1, wherein the grounding plate is formed by stamping a metal board and has two ends respectively soldered on a bottom of the circuit board.

4. The slim USB male connector with anti-disorientation design as claimed in claim 1, further comprising a cable connecting with an end of the circuit board and electrically connecting with the circuits of the USB male connector.

5. The slim USB male connector with anti-disorientation design as claimed in claim 4, wherein the cable is connected with a computer peripheral device.

6. The slim USB male connector with anti-disorientation design as claimed in claim 4, wherein the cable is connected with an electrical connector and forms a connecting cable for transferring data between electric devices.

7. The slim USB male connector with anti-disorientation design as claimed in claim 1, wherein the insulative housing is composed of an upper and a lower housing.

8. The slim USB male connector with anti-disorientation design as claimed in claim 7, wherein the pair of guiding boards of the insulative housing are formed on two side edges of the upper housing, and wherein the upper housing has four upper grooves for exposing the four contacts outside and partitions protruding between each two grooves.

9. The slim USB male connector with anti-disorientation design as claimed in claim 7, wherein the lower insulative housing has a pair of grounding grooves for exposing the grounding plate and receiving the tongues of the frame of the USB socket.

* * * * *